US007987535B1

(12) United States Patent
Tesch

(10) Patent No.: US 7,987,535 B1
(45) Date of Patent: Aug. 2, 2011

(54) SHOWER CORNER SEAT ASSEMBLY

(76) Inventor: Theodore Allen Tesch, Lone Rock, WI (US)

( * ) Notice: Subject to any disclaimer, the term of this patent is extended or adjusted under 35 U.S.C. 154(b) by 254 days.

(21) Appl. No.: 12/464,875

(22) Filed: May 13, 2009

(51) Int. Cl.
*A47K 13/00* (2006.01)
*A47C 3/00* (2006.01)
*A47C 11/00* (2006.01)

(52) U.S. Cl. ..... 4/611; 4/578.1; 297/14; 297/452.2; 211/90.01; 108/42

(58) Field of Classification Search ..... 4/611, 604, 4/578.1; 297/14, 452.2; 211/90.1; 248/250, 248/220.1; 108/42; 312/238
See application file for complete search history.

(56) References Cited

U.S. PATENT DOCUMENTS

| | | | | |
|---|---|---|---|---|
| 1,599,654 | A | 9/1926 | Cranston | |
| 2,261,078 | A | 10/1941 | Shockey | |
| 2,340,545 | A | 2/1944 | Marsh | |
| 2,700,475 | A | 1/1955 | Stalter | |
| 3,640,041 | A | 2/1972 | Michieli | |
| 4,708,310 | A | 11/1987 | Smith | |
| 4,727,606 | A | 3/1988 | Cavey et al. | |
| D360,023 | S | 7/1995 | Hunger et al. | |
| 5,542,218 | A | 8/1996 | Rompel | |
| 5,732,421 | A | 3/1998 | Scherberger | |
| D395,135 | S | 6/1998 | Joss | |
| 6,079,336 | A * | 6/2000 | Lindstrom | 108/42 |
| 6,301,725 | B1 | 10/2001 | Harvey | |
| 2009/0183306 | A1 * | 7/2009 | Kik et al. | 4/611 |

* cited by examiner

*Primary Examiner* — Robert J Canfield
(74) *Attorney, Agent, or Firm* — Loyd W. Bonneville, Attorney

(57) ABSTRACT

A shower corner seat assembly is made up of a seat plate and supporting bracket frame. To fit in the corner, the seat is generally triangular like most others, but with the corner tip of the triangle cut away leaving a four-sided shape. Other minor modifications to true triangularity may also be present. The frame follows the contour of the seat and it, too, is formed to match the corner opening of the seat plate, leaving the framework to be more or less "U"-shaped with the arms of the "U" bent inward tending to somewhat follow the sides of the seat plate. Their ends are, in fact, bent even farther inward so they have to be forced or sprung outward to attach the frame to the shower wall. The openness of the frame near the shower corner makes this possible. The seat plate is then attached to it.

10 Claims, 5 Drawing Sheets

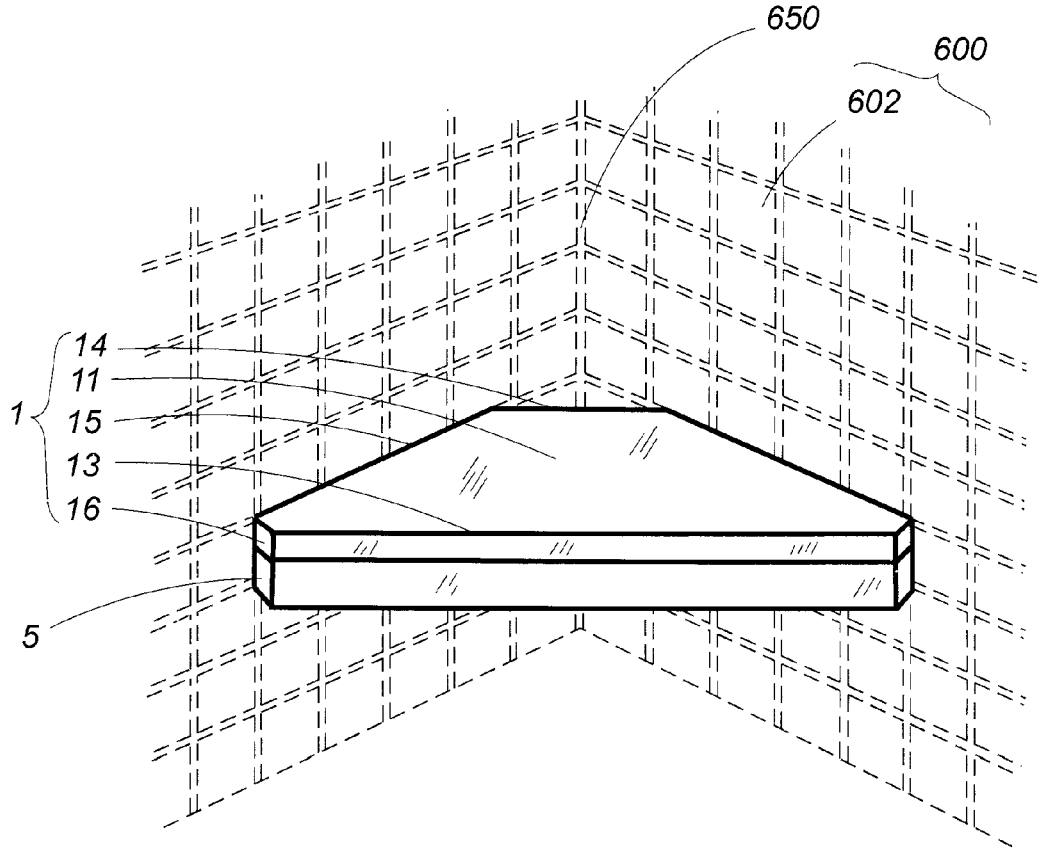
FIG 6
FIG 5
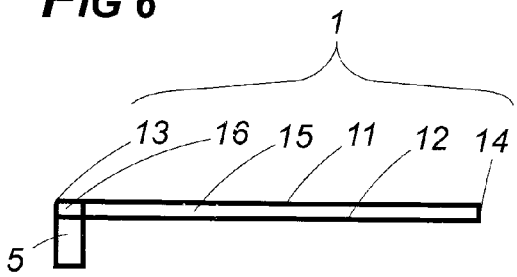
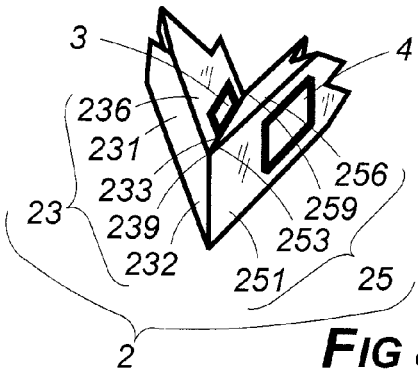
FIG 8
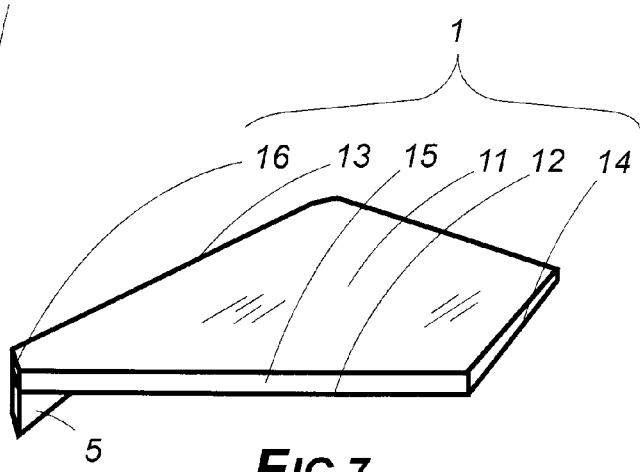
FIG 7

SHOWER CORNER SEAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

Home construction; shower accessories

2. Description of Related Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term bracket frame's transverse extension (23) might be used in one instance but in another, if meaning is otherwise clear from context, expression might be shortened to frame's transverse extension (23) or merely extension (23). Any of those forms is intended to convey the same meaning.

The term attach or fasten or any of their forms when so used means that the juncture is of a more or less permanent nature, such as might be accomplished by nails, screws, welds or adhesives. Thus it is stated herein that each wall attachment limb's proximal end (251) is attached to a respective transverse extension end (232). Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning. Thus, it is stated that FIG. 8 comprises a cut-away view of bracket frame members (23, 25) at a corner of the supporting bracket frame (2), meaning that the latter is in fact the former and the former, the latter. The term comprise may also be characterized by what might be considered one-way equivalency, as when it is stated herein that a threaded bolt and toggle anchor (42) may comprise the frame-to-wall attachment means (4) required for installation. This use of the word has a generic sense to it. That is, a threaded bolt and toggle anchor (42) will always be frame-to-wall attachment means (4) frame-to-wall attachment means (4) may be a threaded bolt and toggle anchor (42) in one case but something else—an adhesive (41), for instance—in another. However, the word comprise may also be used to describe a feature which is part of the structure or composition of a given object. Thus, it is said each the subject matter hereof may comprise an ensconcement lip (5) as a component thereof. The meaning in the respective cases is clear from context, however. Accordingly, modifying words to clarify which of the three uses is the intended one seem unnecessary.

Terms relating to physical orientation such as upper or lower, forward or rearward, refer to the positioning of an object in the manner in which it would be typically oriented for use or viewing. The seat plate (1) and the bracket frame's transverse extension (23) frame's wall attachment limb (25) are, thus, all spoken of as having upper and lower surfaces (11, 236, 256; 12, 237, 257, respectively). The various members of the assembly are also addressed in terms of proximal and distal, the former meaning what is shown to be the portions of the assembly nearer the center of the shower stall, the latter, that farther back toward the corner (650). Consistently, the frontally disposed portion of the assembly's members are said to be the most forward presented thereof. The words inner and outer expressed with respect to the wall attachment limbs (25) refers to the angular relationship between the limbs' distal ends (252)—either toward—inner—or away from—outer—one another (252). These terms of orientation should be interpreted to represent respective aspects or dispositions of members of the assembly in a consistent manner—even if it were, for example, considered positioned upside down in certain instances.

The term angularly and related expressions sharing the same word root indicates extension in other than a transverse manner with reference to its base of origin. One of the two segments of a "V"-shape, for instance, may be properly considered to extend angularly from the other thereof. The term truncation and expressions related to it indicates the removal of an apex otherwise present in a given geometric shape. Thus, the largest truncation of the triangularity otherwise present in the seat plate (1) addressed herein, for example, will be observed to confer upon it (1) a generalized trapezoidal configuration although, in the technical sense, smaller truncations—or nipping away—at each of the other two corners otherwise present more technically confer upon it (1) six distinct sides.

The relational phrase disposed in opposition or equivalents thereof such as opposing and oppositely, indicate dual existence and locus, such as references made to the wall attachment limbs (25) which are present as a pair.

The word transverse and variants thereof describe orientation of one object at a right angle to another. Thus, the bracket frame's transverse extension (23) refers to right angle disposition with reference to a line running forward from the shower's center toward its corner (650)—the line of reference generally assumed herein for observation.

Alphabetical characters are sometimes useful in configuration analogy. The term straight-segmented with reference to an alphabetical character, such as a "U" shape, merely requires consideration of the curved parts thereof as straight lines. The character "U" so used, thus, considers the letter to comprise three straightened parts—a horizontal line and two upwardly extending, but not necessarily transverse, straight lines.

The term tensioned in conjunction with "inward" or "outward" is used herein to address a property of an object, herein having reference to the wall attachment limbs (25), ante. The limbs (25) are said to be factored in a manner by which they (25) are tensioned slightly inward, meaning that their (25) respective configuration is such that they (25) are bent or angled slightly farther inward toward one another (25) than their (25) ultimate disposition becomes upon installation when they are forcibly tensioned outward to effect the desired supportive attachment. The term inherently suggests a springlike character as one of the object's properties and infers the presence of some degree of flexibility.

When speaking of flexibility, the term semi-rigid is sometimes used, meaning that an otherwise unbendable object is factored to comprise just the degree flexibility required for a given purpose. The application of that term herein to the wall attachment limbs (25) characterizes them (25) with the qualities which permit them (25) to be tensioned outward against the shower wall (600) upon installation.

References herein to the shower wall (600) include in a generic sense the wallboard (601) thereof, any tiling (602) thereon and the stud-work (603)—sometimes referred to as "furring strips" (603)—backing the construction.

Shower corner seat assemblies inevitably look much alike, sharing in general, the geometric configuration of a right-angled equilateral triangle. The main challenge presented for them is not so much the shape and placement but, rather, the manner in which they are attached to the walls (600). It is conceivable a shower corner seat assembly might have underlying legs for support as in U.S. Pat. No. 4,727,606 issued to Cavey, et. al. and a line of shower foot-rest standards preceding it, but the trend seems to have instead followed a semi-cantilevered construction—that is, the right-angled sides have been fastened in some manner into or upon the wall (600), wherein somewhat opposing portions of the assembly's circumference relies upon the inherent strength of the wall itself (600). Thus, one will recognize the essence is not true cantilevering but, rather, a sort of skewed support—distinguished from the all-around evenly distributed sort observed in a table or stool.

A configuration wherein the portion of the shower seat nearest the corner (650) comprises the sort of large truncation addressed herein ante, seen also in certain of the prior art assemblies, permits sufficient water to wash down to rinse away soap suds otherwise likely to accumulate on the floor below.

Ever present water, of course, contributes to the weakening of structures over a period of time and deliberate measures have to be taken to keep it away from them. Showers which are not tiled (602) and grouted must comprise water-proof wall-board (601) or other suitable repellant covering. After several months, water allowed to contact the shower corner seat support members can be expected to loosen it, defeating its very purpose. Care must, thus, be taken not only in the follow-up caulking efforts to prevent seepage along the edges of the assembly, but as well in the manner of installation itself. There are inherent difficulties encountered when attempting to install a seat assembly into the corner (650) of a shower. Experience demonstrates that in typical home construction, the corners of any room are not necessarily in square—that is, not true in disposition at 90 degree angles. In a shower stall, even a small variation of that sort makes the installation vulnerable to the incessant attack of water. Unfortunately, insufficient attention has been paid to devising supporting framework comprising features which into account take this out-of-square obstacle and reliably remain securely in place.

In U.S. Pat. No. 3,640,041 issued to Michieli; a set of forms was assembled to cast a concrete triangular seat. Attachment was accomplished merely by cementing the edges into the wall. Later, U.S. Pat. No. 5,732,421 issued to Scherberger provided a grate-like seat supported not by a frame of any sort but rather, like some of the corner shelves, ante, with relatively small brackets anchored through the wall (600) by toggle bolts. The chain of citations therein includes U.S. Pat. No. 2,340,545 issued to Marsh, which featured L-shaped brackets and pieces of hardware superimposed upon one another in jig saw puzzle fashion; U.S. Pat. No. 6,301,725 B1 issued to Harvey and U.S. Pat. No. D395,135 issued to Joss, both of which, like Michieli; merely embedded the seat assembly's edges back to the stud-work (603), presumably without assisting brackets; U.S. Pat. No. D360,023 issued to Hunger, et. al. which incorporated a transverse T-shape construction; and, more significantly, U.S. Pat. No. 5,542,218 issued to Rompel which more admirably comprised a circumferential three-walled frame with toggle bolts.

Aside from bathtub and spa seat assemblies of limited relevance and the alluded-to foot-rests, supra, there were extant a number of soap holders and shelf-work assemblies to hold smaller articles such as that of U.S. Pat. No. 2,261,078 issued to Shocker, U.S. Pat. No. 2,700,475 issued to Staffer and U.S. Pat. No. 4,708,310 issued to Smith; all of which employ small brackets or clips placed along the walls (600) at strategic points. U.S. Pat. No. 1,599,654 issued to Cranston, on the other hand, featured a two-piece interlocking corner shelf which screwed into the wall at its perimeter.

Because of the completeness of the encirclement at its perimeter, even the supporting framework of Rompel has to be more carefully scrutinized with reference to the out-of-square challenges addressed supra. What is needed is a supporting frame which is somehow fashioned so that it can be tensioned in place to better assure its dependability.

While the prior art has undertaken a few approaches to the problem along those lines, it yet remains to provide a structure which better fulfills support concerns.

BRIEF SUMMARY OF THE INVENTION

A shower corner (650) seat assembly comprises a seat plate (1) overlying in attachment a supporting bracket frame (2) specially formed to insure a tight, flexed fit to obviate water deterioration problems. A part of the otherwise triangular shape is cut away at the most distal corner to enhance drainage of water upon the seat plate's upper surface (11) and wash away any accumulation of soap beneath the seat (1). Lateral drainage notches (16) at the front of the assembly may also be present to assist in that respect.

It is the supporting framework (2), however, which is the most prized feature of the assembly. The framework—herein designated a bracket frame (2)—underlies the most of the perimeter or circumference of the seat plate (1) and is deliberately formed open where the most distal corner of the otherwise triangular seat plate (1) has been removed. If properly installed, this construction permits the framework's lateral members (25)—those extending backward toward one another along the shower walls (600) and herein designated its limbs (25)—to be more securely retained in place than otherwise even under the subjection to continual water attack during the operator's (500) shower.

To derive the benefit of the invention, it is only necessary to attach to the walls (600) the most frontal portion of each of the limbs (25)—the proximal end (251)—before attaching the most rearward portion—the distal end (252)—of each (25). The configuration of the bracket frame (2) is such that the distal ends (252) of its limbs (25) are factored slightly bent or stressed inward toward one another (252) such that they (252) must be forced outward for proper installation. Moreover, the (2) composition of the bracket frame (2) is such as to afford it (2) a small degree of flexibility so that it (2) can deliberately be deliberately flexed at its distal end for a precise fit against the wall (600), however out-of-square it (600) might be. Thus, there is a key feature in the bracket frame's (2) construction—this factored inward alignment—which provides the invention its novelty.

Because of the necessity of undertaking a prescribed series of steps, however simple their fulfillment might be—first attaching the limbs' proximal ends (251) and then its distal ones (252)—it is appropriate to regard the invention also as a method of installation as well as a product of manufacture.

BRIEF DESCRIPTION OF THE SEVERAL VIEWS OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention. A heavily framed outline of a portion of the drawing is representative of a number of specific variations of the more generic feature it symbolically identifies.

FIGS. 5-7 illustrate the seat plate (1) of the preferred version with the ensconcement lip (5) attached along the plate's proximal edge (13) comprising, respectively, a perspective view of the assembly installed in the corner (650) of a walk-in shower; a side view of the plate (1) and lip (5); and a perspective thereof (1, 5) also from the side.

FIG. 8 comprises a cut-away view of members (23, 25) at a corner of the supporting bracket frame (2) illustrating generic representations of the frame interconnection means (3) and the frame-to-wall attachment means (4) required for assembly and installation.

DETAILED DESCRIPTION OF THE INVENTION

Figure 1:
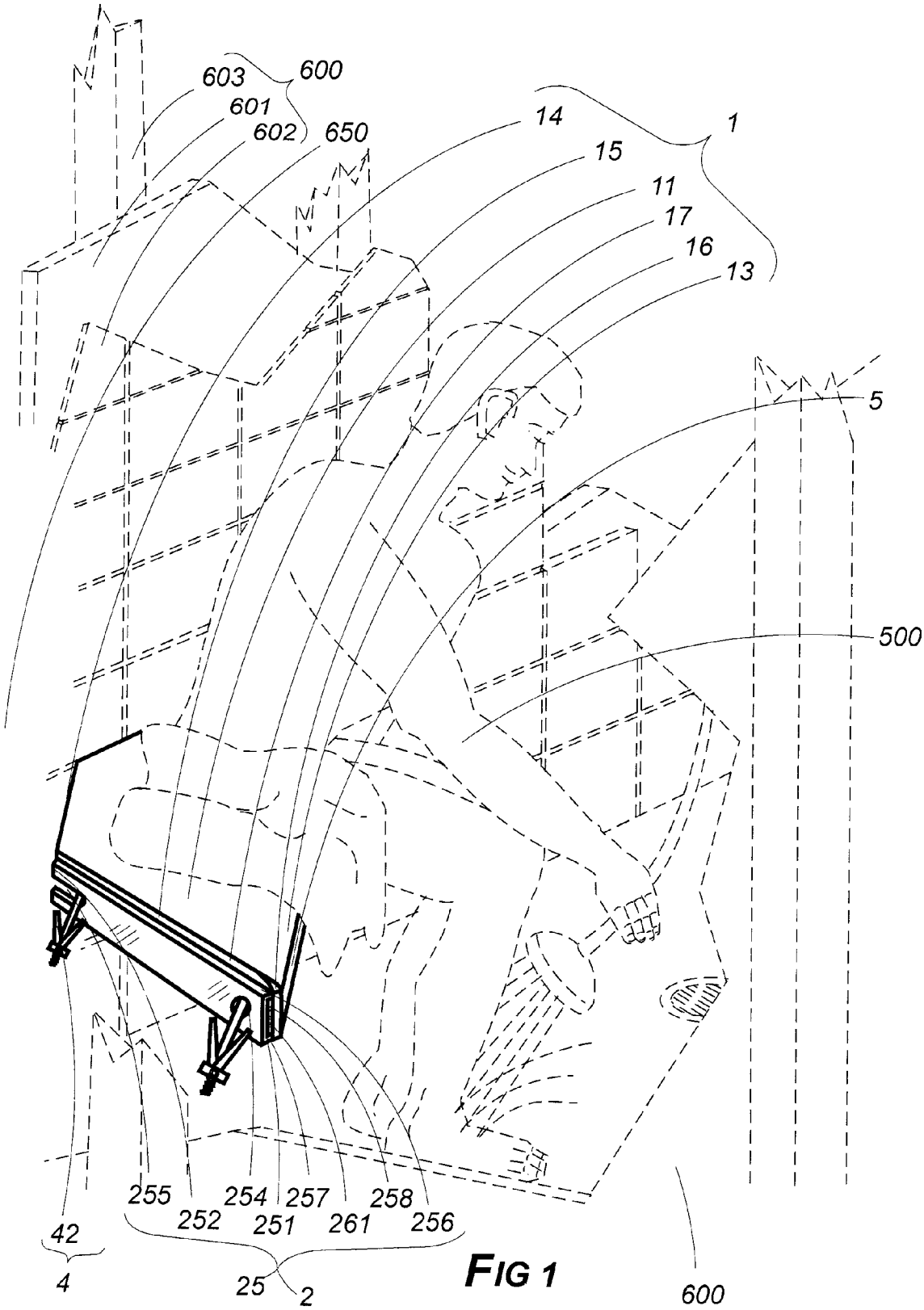
FIG. 1 is a perspective view of a showering operator (500) positioned upon the seat (1) of a preferred version of the shower corner seat assembly.
Figure 2:
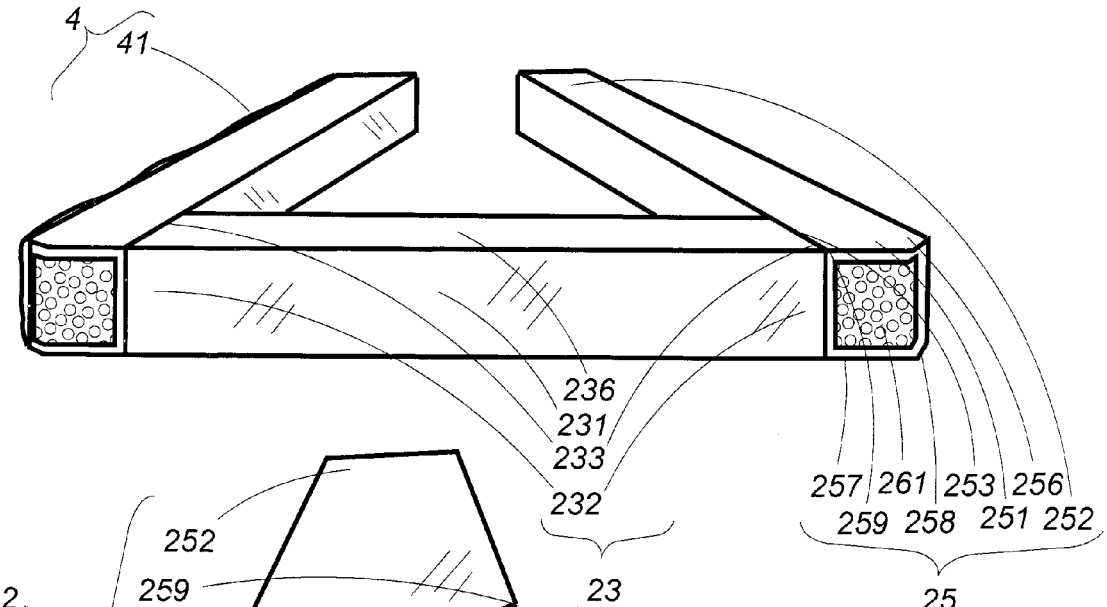
FIGS. 2-4 depict perspective views of the supporting bracket frame (2) of the assembly, the first thereof showing its (2) members interconnected; the second, the wall connecting limb (25) and the third, the transverse extension (23) thereof (2).
Figure 3:
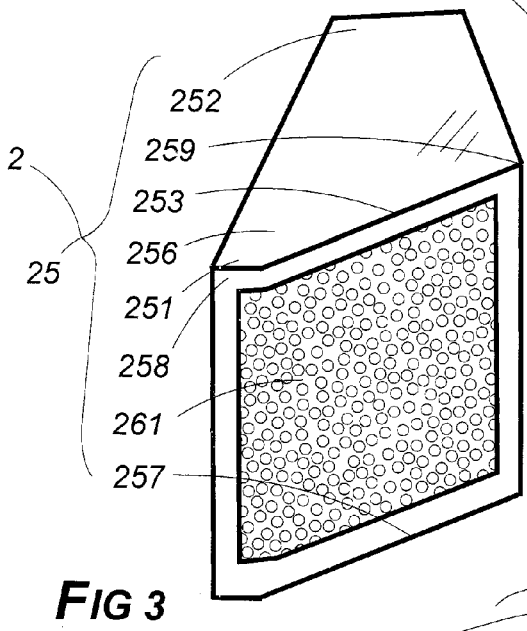
Figure 4:
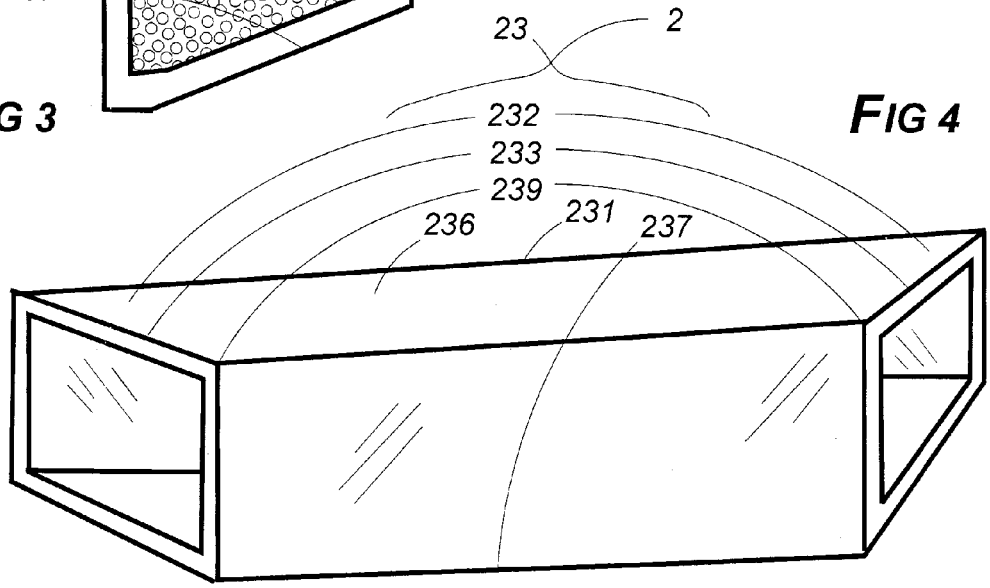
Figure 9:
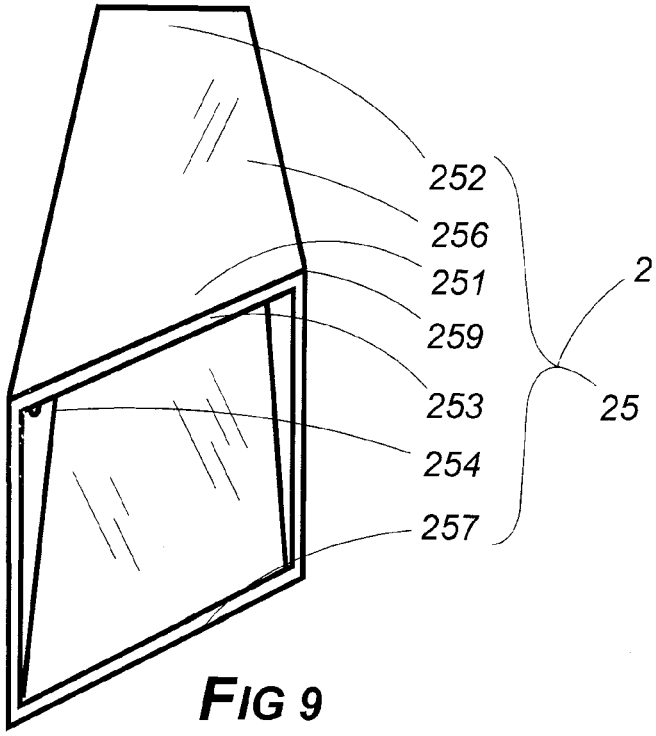
FIGS. 9 and 10 feature in perspective portions of the frame's wall attachment limb (25), the former from the front; the latter from the wall (600) attachment side.
Figure 10:
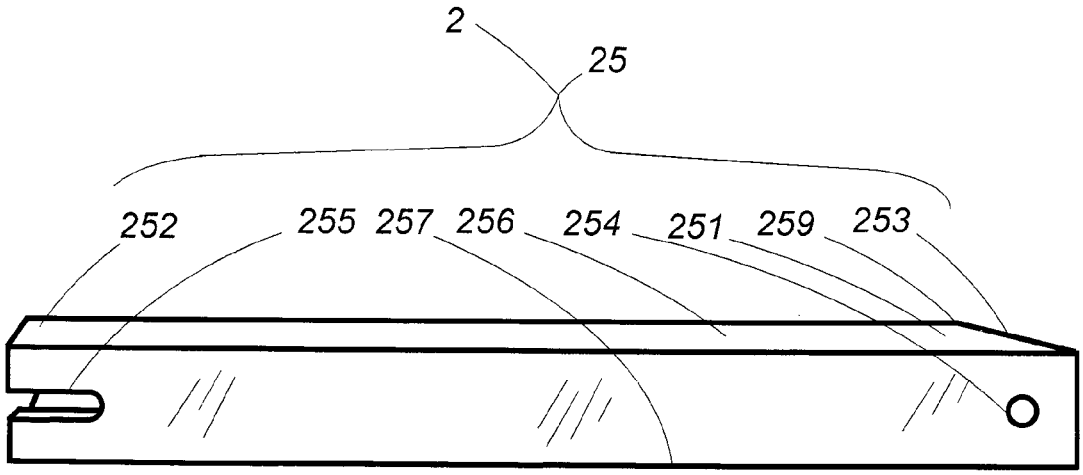
Figure 11:
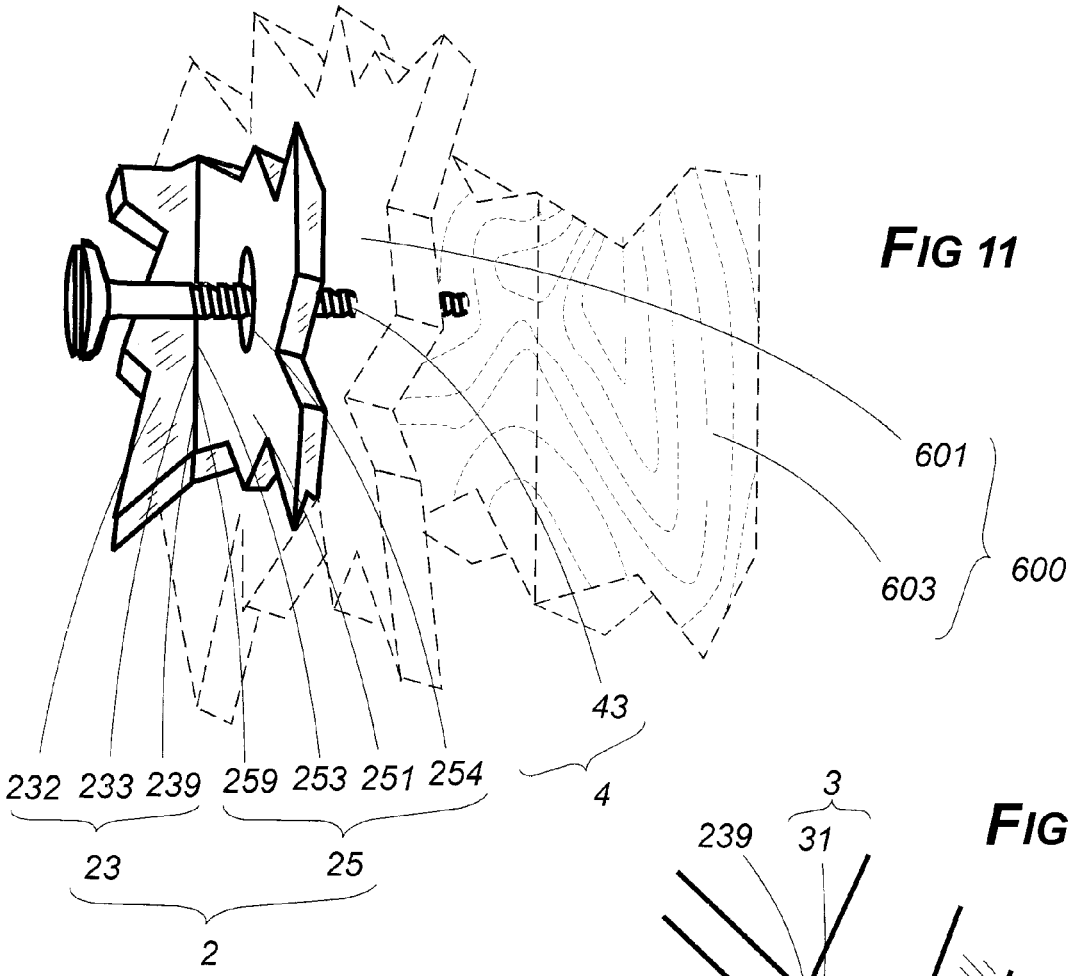
FIG. 11 illustrates in cut-away the application of a threaded penetrating bolt (43) where the presence of stud-work (603) comprises it (43) the most suitable frame-to-wall attachment means (4).
Figure 12:
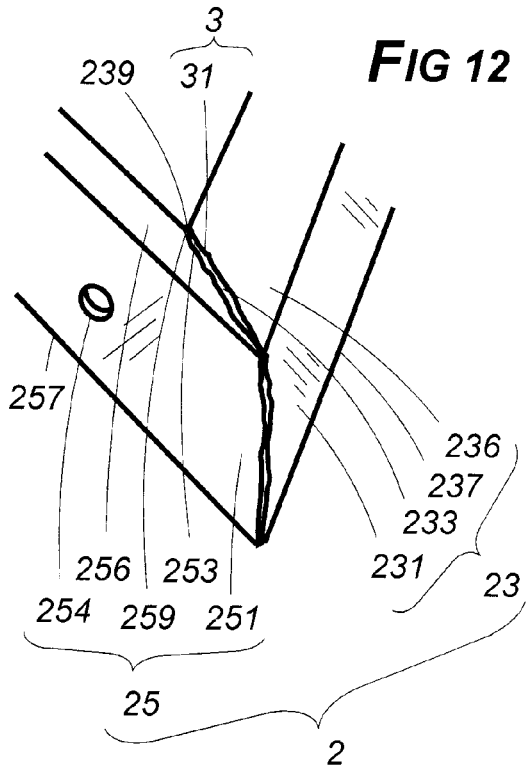
FIGS. 12 and 13 comprise in perspective variants of frame interconnection means (3), the former, a cut-away view of the frame members (23, 25) wherein the means (3), most preferred, comprises a weld (31); the latter, a frontal view of the frame (2) comprising unified interconnection (32) as the means (3).
Figure 13:
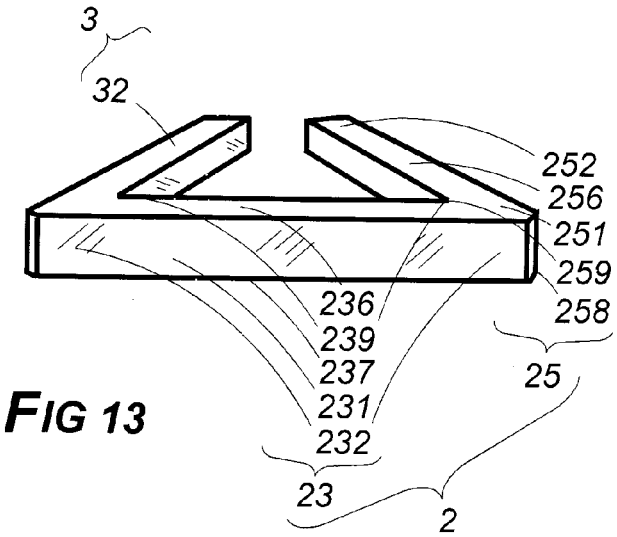

The subject matter hereof comprises a shower corner seat assembly featuring in its most novel respect a supporting bracket frame (2) configured to assure long term stability and dependability so long as installed in a manner availing oneself of the structural advantage it offers.

In the main, the shower corner seat assembly, disposed in the shower corner (650), comprises in combination a seat plate (1) together with the referred to supporting frame (2), frame interconnection means (3) by which frame members (23, 25) are attached to one another (23, 25) and frame-to-wall attachment means (4).

The seat plate (1) may be best visualized as an equilateral right triangle with the right angle apex of the triangle removed, truncating the triangularity to confer upon the shape trapezoidal configuration. It's circumference, thus, comprises a proximal edge (13), a distal edge (14) and angularly opposing wall abutment edges (15). The seat plate (1) further comprises an upper surface (11) and a lower surface (12). Preferably, the shower corner seat assembly further comprises an ensconcement lip (5) disposed along the seat plate's proximal edge (13) so as to cover the most forward presented portions of the seat plate (1) and bracket frame (2) for reasons of safety and aesthetics. This description presents a generalized easily visualized configuration although certain optional refinements addressed ante would somewhat modify the seat plate's (1) true geometry.

Most preferably, the supporting bracket frame (2) is comprised of what is generally recognized as hollow bar stock-tubing of square or rectangular cross-section. Composition is such as to provide semi-rigidity providing strength with the degree of flexibility addressed ante. It (2) comprises a transverse extension (23) and opposing wall attachment limbs (25), one for each of the two adjoining walls (600) which meet in the shower corner (650).

The frame's transverse extension (23) is configured as an elongated structure comprising opposing ends (232), a frontal surface (231), an upper surface (236), a lower surface (237) and opposing posterior corners (239).

Each wall attachment limb (25), configured as an elongated structure, comprises a proximal end (251), a distal end (252), an upper surface (256), a lower surface (257) and an inside proximal corner (259). The limbs (25) are readily observed as essentially, if not exactly, identical if one (25) is turned upside down with respect to the other (25).

The proximal end (251) of each of the frame's wall attachment limbs (25) is angularly attached to a respective transverse extension's end (232) so as to confer upon the bracket frame (2) a straight-segmented angularly altered "U" shape closely matching—with the exceptions herein provided—the circumferential portion of the seat plate (1) in size and configuration. Thus, the length and angularity of the bracket frame's transverse extension (23) generally matches the length and angularity of the seat plate's proximal edge (13); and the length of each bracket frame's wall attachment limb (25) generally matches that of the seat plate's respective wall abutment edge (15) with the exception, nonetheless, that their angularity be such as to dispose their distal ends (252) slightly inward toward one another (252).

The shower corner seat assembly further comprises frame interconnection means (3) by which each wall attachment limb's proximal end (251) is attached to a respective transverse extension end (232). While the means (3) may comprise unified, one-piece, integration (32) of the respective members (23, 25), to avoid manufacturing costs and certain complexities anticipated in unified construction, a weld (31) of separated pieces (23, 25) is preferred. Where aluminum is employed as the frame's (2) composition, as preferred, tungsten inert gas technology may be successfully adopted for the purpose.

Attachment of the frame's wall attachment limbs (25) to the wall (600) is accomplished by what is herein addressed as frame-to-wall attachment means (4). For proper attachment to the adjoining walls (600) of a walk-in shower corner (650), the limbs (25) must comprise composition and configuration permitting their distal ends (252) to be spring-tensioned outward from their (25) slight inward disposition, supra. This characteristic is sufficiently significant to require some elaboration.

The use of the adjectives "closely" or "generally" in conjunction with the word "match" herein identifies this crucial feature of the bracket frame's (2) structure—thus addressing the most important of the exceptions referred to supra. By reason of the inherent geometry herein, one would ordinarily anticipate the interior angle between the transverse extension (23) and each respective wall attachment limb (25) to equal or approximate 45 degrees. The actual interior angle for each limb (25) is deliberately made less than that, however—the limbs' distal ends (252) disposed slightly farther inward toward one another, supra—so that in installation, they (252) must be forced outward to meet the shower wall (600) they (25) attach to. Experience dictates that to facilitate that effort, the limbs' proximal ends (251) should be attached before undertaking that task with the distal ends (252). It is for the reason of this undertaking of outward forcing of the distal ends (252) that the flexibility insisted upon supra be present. It has been observed this particular arrangement provides a snug fit overcoming attachment difficulties otherwise often presented by out-of-square shower corners (650).

Further elaboration is also appropriate concerning the frame interconnection means (3). Preferably, the attachment of the wall attachment limbs' ends (251) to those (232) of the transverse extension (23) is undertaken by first removing a portion of the attaching ends (231, 251) of each (23, 25, respectively). Thus, the posterior corners (239) are cut away from the transverse extension's upper and lower surfaces (236, 237) at a given angle disposing at each end (232) therein (23) an angular transverse extension cut (233). The inside corners (259) of the proximal end (251) of each wall attachment limb (25) are similarly cut away from that member's upper and lower surfaces (256, 257) at a given angle disposing therein (25) an angular wall attachment limb cut (253). Where this manner of attachment is adopted, the angular cuts (231, 251) of the frame's members (23, 25, respectively) must be such that the angular transverse extension cut (231) meets flush with the angular wall attachment limb cut (251) in a manner providing a mitred joint so as to dispose the frame's angular configuration to closely match—with the exceptions herein noted—the circumferential portion of the seat plate (1) in size and configuration as described supra. The juncture of the transverse extension (23) and limbs (25) may, thus, be considered to provide a mitred joint, albeit one disposing members (23, 25) at other than a right angle.

The seat plate (1) is disposed in attachment to overlie the supporting bracket frame (2) in a manner disposing the wall abutment edges (15) tightly against the respective walls (600).

It should be recognized, however, that the bracket frame's wall attachment limbs (25) may be attached either to the wall's tile (602), if present, to the wallboard (601) or to underlying stud-work (603). If attachment is made through any tiling (602) and directly to either the wallboard (601) or the stud-work (603), the seat plate (1) preferably comprises disposed along each wall abutment edge (15), a lateral recess (17) to accommodate the adjoining tile (602)—that is, so that the meeting of the wall abutment edges (15) and the tile-work is continuous. Similarly, where attachment in such depth is undertaken, the bracket frame itself (2) is preferably configured to comprise a tile abutment truncation (258) disposed at its (2) opposing corners at the juncture of the transverse extension (23) and the wall attachment limbs (25). The differentiation between the dimensions of the seat plate (1) and the supporting bracket frame (2) to address these tile (602) abutment concerns comprises the second exception to the "closely matching" or "generally matching" references for the respective configurations supra.

The supporting bracket frame's wall attachment limbs (25) are attached to the shower walls (600) by frame-to-wall attachment means (4). An adhesive (41) or a threaded bolt and toggle anchor (42) may comprise the means (4). In instances in which a stud furring strip or other stud-work (603) is encountered, however, the means (4) more properly comprises a threaded penetrating bolt (43). Each wall attachment limb (25) comprises a bolt accommodating aperture (254) disposed at its proximal end (251) where either of the latter (42, 43) are adopted for attachment. However, to facilitate attachment at the distal end (252), each limb (25) preferably comprises in place of an aperture (254), a distal tension relief attachment notch (255), a slot-like opening permitting desired bolt movement within the opening (255) for proper alignment at that site.

As a further refinement to avoid some accumulation of moisture and enhance aesthetics, the seat plate (1) preferably comprises opposing lateral drainage notches (16) disposed at its wall abutment edges (15) at its proximal edge (13). This nipping away of the frontal tips of the seat plate (1), where undertaken, comprises a minor modification or exception to generalized geometric references otherwise considered for the seat plate (1), supra. When drainage notches (16) are thus provided, it is preferable also to bevel the opposing ends of the ensconcement lip (5) to match the angle of the notches (16).

To avoid potential mildew problems and facilitate cleaning, it is also preferable to stuff the attachment limbs' (25) tubing hollows, where present, with filler (261) such as polystyrene foam.

The special bracket frame (2) installation feature addressed herein appropriately suggests a methodology or process recital to comprise the subject matter hereof, herein designated a method of installing a shower corner (650) seat assembly, undertaking sequentially the following steps:

first, fashion a seat plate (1) to comprise upper and lower surfaces (11, 12, respectively) of equilateral right triangle configuration;

second, truncate the seat plate's (1) triangularity, removing the right-angled apex of the triangle, thereby conferring upon the plate (1) trapezoidal configuration comprising about its (1) circumference a proximal edge (13), a distal edge (14) and angularly opposing wall abutment edges (15);

third, fashion a seat plate supporting bracket frame (2) to comprise a transverse extension (23) and opposing wall attachment limbs (25); the transverse extension (23) comprising opposing ends (232), a frontal surface (231), an upper surface (236), a lower surface (237) and opposing posterior corners (239); each wall attachment limb (25) comprising a proximal end (251), a distal end (252), an upper surface (256), a lower surface (257) and an inner proximal corner (259);

fourth, angularly attach with frame interconnection means (3) the proximal end (251) of each wall attachment limb (25) to a respective end (232) of the transverse extension (23), conferring upon the bracket frame (2) a straight-segmented angularly altered "U" shape closely matching, with exception hereinafter set forth, the seat plate's (1) circumference in size and configuration wherein the length and angularity of the bracket frame's transverse extension (23) generally matches the length and angularity of the proximal edge (13) of the seat plate; and the length of each of the bracket frame's wall attachment limbs (25) generally matches that of a respective seat plate's wall abutment edge (15), nevertheless, as an exception to attaching it (25) to closely match the seat plate's (1) circumference in size and shape, disposing their distal ends (252) slightly farther inward toward one another (252);

fifth, position the shower corner (650) seat assembly in the shower's corner (650);

sixth, attach the wall attachment limbs' distal ends (252) by frame-to-wall attachment means (4) snugly against respective shower walls (650), spring-tensioning the limbs (25) outward from their (25) slight inward disposition;

seventh, attach the seat plate (1) to overlie the supporting bracket frame (2) in a manner disposing its wall abutment edges (15) tightly against the respective walls (600)

The inventor hereby claims:

1. A shower corner seat assembly comprising a seat plate;

a seat plate supporting bracket frame;

frame interconnection means; and frame-to-wall attachment means;

the seat plate comprising opposing upper and lower surfaces of equilateral right triangle configuration wherein the right-angled apex is removed, truncating the triangularity to confer upon the plate trapezoidal configuration, comprising about its circumference a proximal edge, a distal edge and angularly opposing wall abutment edges; and further comprising an upper surface and a lower surface;

the seat plate supporting bracket frame comprising an elongated transverse extension and opposing elongated wall attachment limbs;

the transverse extension comprising opposing ends, a frontal surface, an upper surface; a lower surface; and opposing posterior corners;

each wall attachment limb comprising a proximal end, a distal end, an upper surface, a lower surface and an inner proximal corner;

the proximal end of each wall attachment limb angularly attached to a respective end of the transverse extension, conferring upon the bracket frame a straight-segmented angularly altered "U" shape closely matching, with exception hereinafter set forth, the circumference of the seat plate in size and configuration wherein the length and angularity of the transverse extension of the bracket frame generally matches the length and angularity of the proximal edge of the seat plate; and the lengths of the wall attachment limbs of the bracket frame generally match those of the respective wall abutment edges of the seat plate with exception nevertheless, that their distal ends be disposed slightly farther inward toward one another;

the shower corner seat assembly further comprising frame interconnection means by which each wall attachment limb's proximal end is attached to a respective end of the transverse extension;

the shower corner seat assembly further comprising frame-to-wall attachment means;

the wall attachment limbs comprising composition and configuration to permit their distal ends to be spring-tensioned outward from their slight inward disposition upon attachment to the adjoining walls of a walk-in shower corner, wherein a snug fit is assured irrespective of any out-of-square configuration the wall corner might comprise;

the seat plate disposed in attachment to overlie the seat plate supporting bracket frame in a manner disposing its wall abutment edges tightly against the respective walls;

whereby an operator may undertake a shower in seated posture upon the seat.

2. The shower corner seat assembly according to claim 1 further comprising an ensconcement lip disposed along the seat plate's proximal edge to overlie the frontal portion of the bracket frame's transverse extension; whereby the shower seat's safety and aesthetics are enhanced.

3. The shower corner seat assembly according to claim 1 wherein the frame interconnection means comprises welds.

4. The shower corner seat assembly according to claim 1 wherein the frame interconnection means comprises unified, one-piece integration, comprising the bracket frame an integral construction.

5. The shower corner seat assembly according to claim 1 wherein the transverse extension and wall attachment limbs comprise separate members of the seat supporting bracket frame attached to one another;

wherein the transverse extension's posterior corners are cut away from the transverse extension's upper and lower surfaces at a given angle disposing at each end therein an angular transverse extension cut; and the inner corner of the proximal end of each wall attachment limb is cut away from that member's upper and lower surfaces at a given angle disposing therein an angular wall attachment limb cut; such that the angular transverse extension cuts meet flush with the respective angular wall attachment limb cuts in a manner providing a mitred joint.

6. The shower corner seat assembly according to claim 1 wherein the seat plate comprises disposed along each wall abutment edge, a lateral recess and each wall attachment limb comprises an abutment truncation to provide a continuous surface accommodating the presence of tile-work upon the wall.

7. The shower corner seat assembly according to claim 1 wherein the bracket frame's frame-to-wall attachment means comprises an adhesive.

8. The shower corner seat assembly according to claim 1 wherein the bracket frame's frame-to-wall attachment means comprises one of threaded bolts and toggle anchors; and threaded penetrating bolts; and each wall attachment limbs comprise near its proximal end, a bolt accommodation aperture of size at least equal to the diameter of the respective bolt shanks; and near its distal end, a tension relief attachment slot of size permitting desired bolt movement therein for proper alignment thereat.

9. The shower corner seat assembly according to claim 1 further comprising opposing lateral drainage notches disposed along the seat plate's proximal edge.

10. A method of installing a shower corner seat assembly, the method comprising the following steps:

first, fashion a seat plate to comprise upper and lower surfaces of equilateral right triangle configuration;

second, truncate the seat plate's triangularity, removing the right-angled apex of the triangle, thereby conferring upon the plate trapezoidal configuration comprising about its circumference a proximal edge, a distal edge and angularly opposing wall abutment edges;

third, fashion a seat plate supporting bracket frame to comprise a transverse extension and opposing wall attachment limbs; the transverse extension comprising opposing ends, a frontal surface, an upper surface, a lower surface and opposing posterior corners; each wall attachment limb comprising a proximal end, a distal end, an upper surface, a lower surface and an inner proximal corner;

fourth, angularly attach with frame interconnection means the proximal end of each wall attachment limb to a respective end of the transverse extension, conferring upon the bracket frame a straight-segmented angularly altered "U" shape closely matching, with exception hereinafter set forth, the seat plate's circumference in size and configuration wherein the length and angularity of the bracket frame's transverse extension generally matches the length and angularity of the proximal edge of the seat plate; and the length of each of the bracket frame's wall attachment limbs generally matches that of a respective seat plate's wall abutment edge, nevertheless, as an exception to attaching it to closely match the seat plate's circumference in size and shape, disposing their distal ends slightly farther inward toward one another;

fifth, position the shower corner seat assembly in the shower's corner;

sixth, attach the wall attachment limbs' distal ends by frame-to-wall attachment means snugly against respective shower walls, spring-tensioning the limbs outward from their slight inward disposition;

seventh, attach the seat plate to overlie the supporting bracket frame in a manner disposing its wall abutment edges tightly against the respective walls.

* * * * *